US008425193B2

(12) United States Patent
Masserey et al.

(10) Patent No.: US 8,425,193 B2
(45) Date of Patent: Apr. 23, 2013

(54) BLADE ROW FOR THE FINAL STAGE OF A STEAM TURBINE

(75) Inventors: Pierre-Alain Masserey, Würenlos (CH); Rolf Hunziker, Dintikon (CH); Benedikt Wanner, Emmenbrücke (CH)

(73) Assignee: ALSTOM Technology Ltd, Baden (CH)

( * ) Notice: Subject to any disclaimer, the term of this patent is extended or adjusted under 35 U.S.C. 154(b) by 52 days.

(21) Appl. No.: 13/071,235

(22) Filed: Mar. 24, 2011

(65) Prior Publication Data

US 2011/0268574 A1 Nov. 3, 2011

Related U.S. Application Data

(63) Continuation of application No. PCT/EP2009/061602, filed on Sep. 8, 2009.

(30) Foreign Application Priority Data

Sep. 29, 2008 (CH) ..... 1540/08

(51) Int. Cl.
*F01D 5/22* (2006.01)

(52) U.S. Cl.
USPC ..... 416/191

(58) Field of Classification Search ..... 416/189, 416/190, 191, 192, 193 A, 193 R, 195, 196 R; 415/169.3
See application file for complete search history.

(56) References Cited

U.S. PATENT DOCUMENTS

| | | | | |
|---|---|---|---|---|
| 3,751,182 | A | 8/1973 | Brown | |
| 6,402,474 | B1 * | 6/2002 | Okuno | 416/190 |
| 2008/0175712 | A1 * | 7/2008 | Asai et al. | 416/179 |

FOREIGN PATENT DOCUMENTS

| | | | |
|---|---|---|---|
| DE | 20023475 | U1 | 5/2004 |
| EP | 1609951 | A1 | 12/2005 |
| EP | 1911935 | A2 | 4/2008 |
| GB | 2138892 | A | 10/1984 |
| JP | 2005133543 | A | 5/2005 |

* cited by examiner

*Primary Examiner* — Edward Look
*Assistant Examiner* — William Grigos
(74) *Attorney, Agent, or Firm* — Volpe and Koenig, P.C.

(57) ABSTRACT

A rotating blade row is provided for the final stage of a steam turbine has blades with an integrated shroud. The shroud of each blade has a projection in the axial direction, in each case on its pressure side, which prevents droplets in the working fluid of the steam turbine from reaching the shroud fillet of the respective subsequent blade in the flow direction. The shroud fillet is therefore protected against erosion damage caused by droplets impact erosion. The projection is positioned and of such a size that mass equilibrium is ensured between the suction side and the pressure side of the shroud, and stress equilibrium is ensured between the projection on the pressure side and the suction-side shroud. The projection furthermore has a recess between its greatest axial extent and the leading edge.

6 Claims, 3 Drawing Sheets

BLADE ROW FOR THE FINAL STAGE OF A STEAM TURBINE

CROSS REFERENCE TO RELATED APPLICATION

This application is a continuation of International Application No. PCT/EP2009/061602 filed Sep. 8, 2009, which claims priority to Swiss Patent Application No. 01540/08, filed Sep. 29, 2008, the entire contents of all of which are incorporated by reference as if fully set forth.

FIELD OF INVENTION

The invention relates to a rotating blade row for the final stage of a steam turbine, and in particular to shrouds for the final stage blades.

BACKGROUND

Steam turbines, to be more precise low-pressure steam turbines, have a blade row of final stage blades in the final stage which, because of their great length and mass in comparison to blades in other stages, are subject to correspondingly great centrifugal forces and oscillations during turbine operation. In order to damp these oscillations, each final stage blade in this blade row typically has a shroud which, on the sides facing the blades adjacent in the circumferential direction, is designed such that it in each case engages in the shroud of the adjacent blades. Furthermore, the shrouds are designed and are of such a size that the centrifugal forces are limited as much as possible, and the loads are distributed as uniformly as possible. In particular, the shrouds of final stage blades have smaller overhangs than the shrouds of other stages in the turbine.

Frequently, the final stage blades additionally have a snubber at the mid-height of the blades, in order to further damp the oscillations.

Because of the wet-steam environment, erosion damage frequently occurs on final stage blades, caused by droplets impact. Various measures are known for reducing or preventing such damage, for example from EP1609951 and JP2005133543. In EP1609951, a final stage blade is disclosed with an integrated shroud which has a step in the area of the blade leading edge which is affected by erosion damage, said step extends radially inward in the direction of the blade foot, and has a curved surface along the side of the shroud. These measures eliminate the problem zone, reducing the potential for accumulation of moisture.

JP2005133543 discloses rotating blades, inter alia, also for the final stage, whose inlet edge has an erosion shield consisting of a hardened zone which extends from the blade tip in the direction of the blade foot.

EP 1911935 discloses a final stage blade of a steam turbine having an integrated shroud, in which the trailing edge of a blade is in contact with the leading edge of the adjacent blade, by means of a torsion force. The trailing edge is in each case designed to be radially stepped for this purpose.

DE20023475 discloses a final stage blade with an integrated shroud as well as ribs on the shroud, which are used to shield blade parts against water droplets.

SUMMARY

The present disclosure is directed to a rotating blade row for a final stage of a steam turbine having blades in each case with an integrated shroud. The shroud of each blade in the row has a projection on a pressure side thereof, for shielding a suction-side shroud fillet of a next blade in a flow direction against at least a portion of water droplets.

DETAILED DESCRIPTION OF THE PREFERRED EMBODIMENTS

Introduction to the Embodiments

Figure 1:
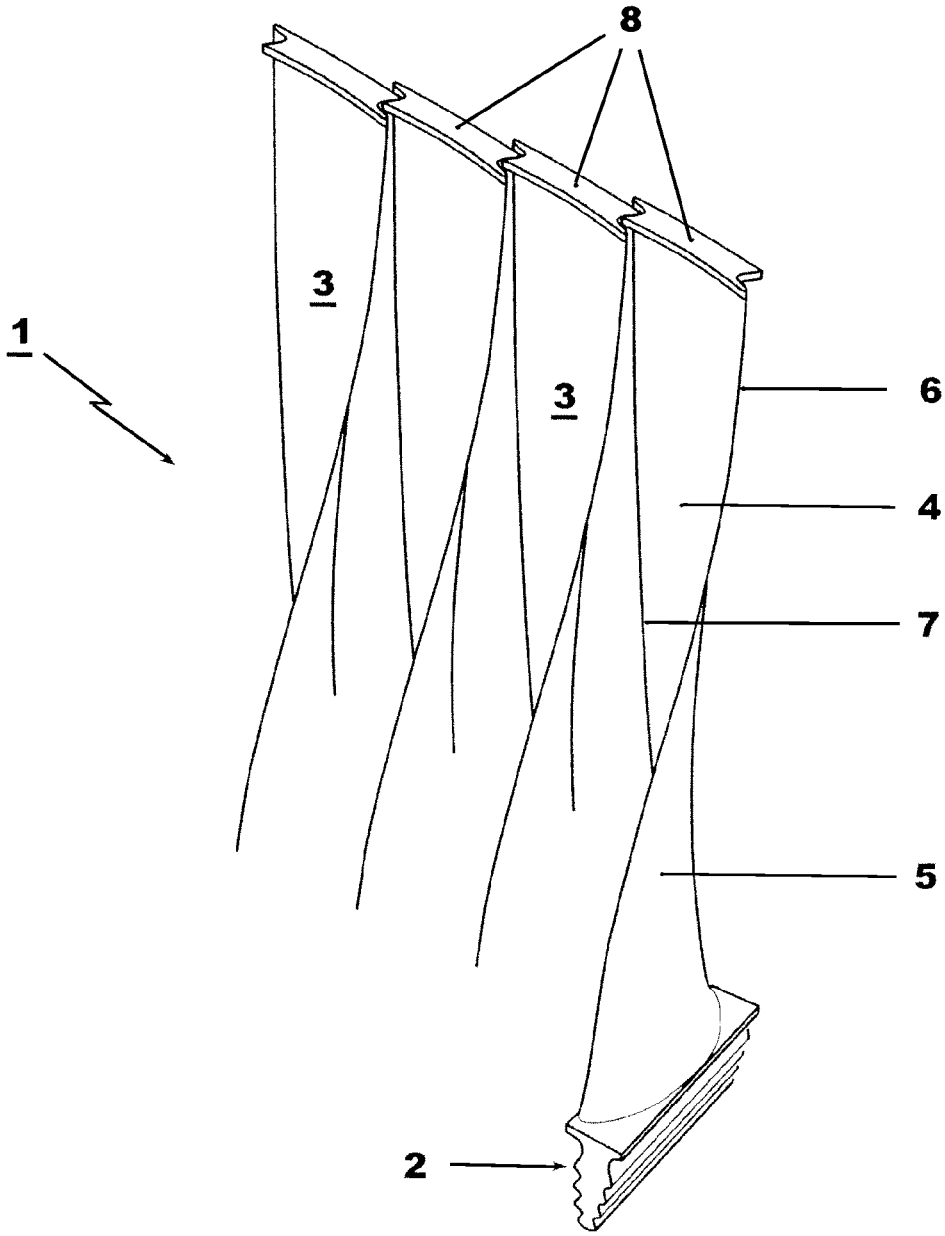
FIG. 1 shows a perspective view of a part of a typical blade row, which rotates according to the prior art, in the final stage of a steam turbine.

The present invention is based on the object of providing a rotating blade row for the final stage of a steam turbine, whose susceptibility to erosion damage is reduced, particularly on the shroud fillet on the suction side of the blade, that is, in the transitional zone between the suction side of the shroud and the suction side of the airfoil, toward the leading edge.

This object is achieved by a rotating blade row as claimed in the independent claim. Special embodiments of the invention are specified in the dependent claims.

A rotating blade row for the final stage of a steam turbine has blades which each have an integrated shroud, with the shrouds, which overhang the airfoil of the blades which are adjacent in the blade row, in each case engaging in one another in the area of their trailing and leading edges. According to the invention, the shroud of each blade in the row in each case has a projection on its pressure side, which prevents droplets in the working fluid of the steam turbine from reaching the shroud fillet of the next blade in the flow direction, that is to say, the transitional zone between the suction-side shroud and the suction-side airfoil toward the leading edge. The projection shields the suction-side shroud fillet of each blade against water droplets, and against corresponding damage caused by droplets impact erosion.

The projection according to the invention on the shroud extends so far in the direction parallel to the rotor axis of the steam turbine that at least some of the water droplets, in particular the larger water droplets, are deflected by the projection, are carried along by the working flow, and are moved in the flow direction or in an angle range around the flow direction of the turbine working flow. In the absence of a projection according to the invention, these droplets would reach the shroud fillet of the next blade in the flow direction.

The projection for shielding the suction-side shroud fillet of the next blade in the flow direction is, in particular, arranged in the area of the leading edge of each blade, thus ensuring a mass equilibrium of the shroud between the suction side and pressure side of the shroud. In addition, the projection is designed such that a stress equilibrium exists between the projection on the pressure side and the suction-side shroud. Since, because of the mass and stress equilibrium, the projection is arranged at a distance from the trailing edge of the blade and closer to the leading edge, the projection has to be larger, since it extends further in the axial direction, that is to say parallel to the rotor axis of the steam turbine, in order to ensure shielding of the suction-side shroud fillet of the next blade in the flow direction.

In order to avoid strength problems, the projection is designed to be correspondingly larger in its radial extent toward the blade foot, that is to say, in the area of the projection, the shroud has a larger radial extent than other areas of the shroud.

Typically, the leading edges of blades in the final stage of the steam turbine are hardened. In order to allow the hardening process on the leading edge of the blade, the projection has a recess between its greatest axial extent and the leading edge of the blade.

DETAILED DESCRIPTION

FIG. 1 shows typical rotating final stage blades 1, as known from the prior art, for a steam turbine, which are arranged in a blade row on a rotor, which is not shown, of a steam turbine. The blade foot 2, the airfoil 3, its pressure side 4, suction side 5, leading edge 6 and trailing edge 7, as well as the shroud 8 which is integrated with the airfoil 3, are in each case illustrated. The shrouds 8 on adjacent blades 1 in the row are designed such that they engage one another in the area of their leading and trailing edges 6, 7, thus damping oscillations as much as possible during operation. In order to keep the mass of the shrouds and, correspondingly, the centrifugal forces, as low as possible, the shrouds are typically designed to be narrow with a limited total mass and overhangs which are as small as possible beyond the extents of the contour of the airfoil at the blade tip.

Figure 2A:
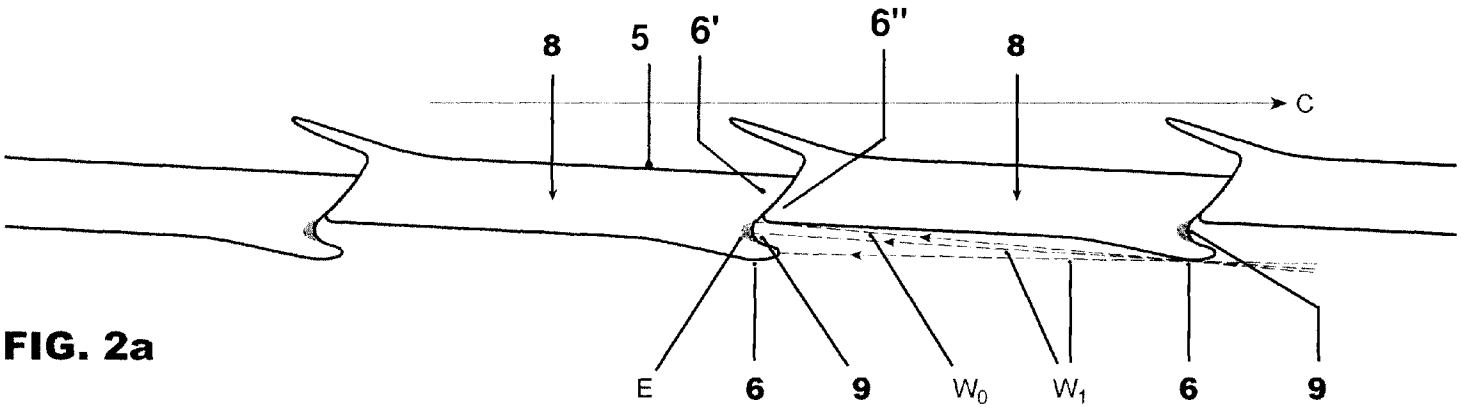
FIG. 2*a* shows a plan view of shrouds of a row of final stage blades according to the prior art.

FIG. 2*a* shows a plan view of the contour of known shrouds 8 with a leading edge 6, trailing edge 7, pressure side 4 and suction side 5, with the shroud having parts 6' and 6", which overhang the contour of the airfoil, on the suction side close to the leading edge and on the pressure side close to the trailing edge. Furthermore, in the area of the leading edge 6, they have a shroud fillet 9 on the suction side 5 of the blade. The shroud fillet 9 is located in the transitional zone from the suction side of the airfoil close to the leading edge 6 to the part 6' of the shroud which extends to overhang over the suction side and makes contact with the overhanging part 6" on the pressure side of the adjacent shroud. Water droplets which are dragged along by the working flow of the steam turbine strike the shroud fillets 9, where erosion damage can occur in the area E indicated by shading. In this case, relatively small water droplets are dragged along more than larger ones by the steam flow. Relatively small water droplets are moved, for example, along paths $W_0$ close to the flow direction, while larger water droplets, which are dragged along to a lesser extent than the smaller ones because of their mass, are moved along the paths $W_1$.

Figure 2B:
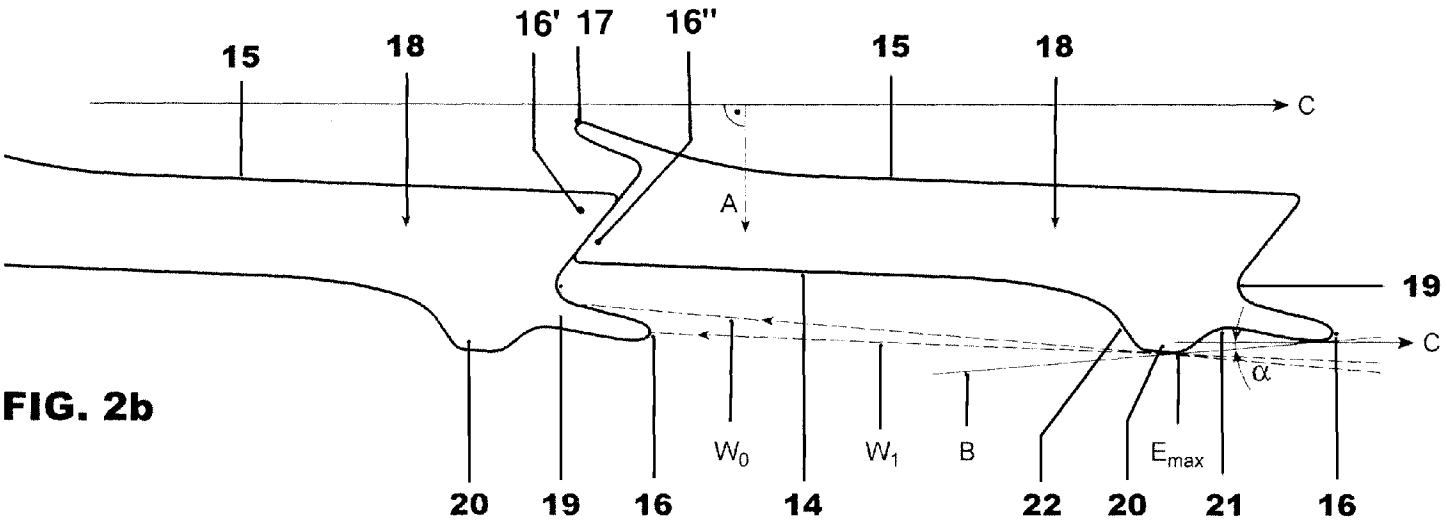
FIG. 2*b* shows a plan view of shrouds of a row of final stage blades according to the invention.

FIG. 2*b* shows blades 10 in a blade row for the final stage of a steam turbine, in each case having a shroud 18 according to the invention, which is integrated with the airfoil, once again in the form of a plan view as in FIG. 2*a*. The figure once again shows the leading edge 16, trailing edge 17, pressure side 14, suction side 15 and the parts 16' and 16" of the shroud which form an overhang close to the leading edge of the airfoil on the suction side and close to the trailing edge of the airfoil on the pressure side. The shroud fillet 19 is located in the transitional zone between the suction-side, overhanging part 16' of the shroud and the suction side of the airfoil toward the leading edge 16. On its pressure side 14 and in the area of its leading edge 16, the shroud 18 has a projection 20 which is used to shield the shroud fillet 19 on the suction side 15 of the next blade shroud in the flow direction against water droplets. The arrangement of the projection 20 in the area of the leading edge 16 and at least in the front half, facing the leading edge 16, of the blade shroud 18 avoids an additional overhang in the trailing-edge area and a potential, associated with this, for strength problems of the shroud. In its extent in the axial direction A, that is to say at right angles to the rotation direction C and parallel to the turbine rotor axis, the projection 20 is designed such that at least the largest droplets which are dragged along in the working flow are deflected. As a result of the deflection, the droplets flow in the direction of the turbine housing, and leave the flow channel of the turbine there via an extraction system. The leading edge 16 and the shroud fillet 19 of each shroud 18 in the blade row are therefore protected against droplet impact erosion by the projection 20 on the next blade shroud in the flow direction.

The maximum extent of the projection 20 in the axial direction A is defined on the basis of the criterion that the angle $\alpha$ between the rotation direction C and the line which leads from the leading edge 16 of the blade to the maximum axial extent $E_{max}$ of the projection 20 is as small as possible.

Furthermore, the projection also includes two flanks of which a front flank of the projection facing the leading edge 16 has a recess 21. The recess is therefore located between the leading edge 16 of the blade and the maximum axial extent $E_{max}$ of the projection 20. This ensures a reduction in the mass of the shroud and, in particular, access to the leading edge in order to harden the airfoil material along the leading edge 16. A trailing flank 22, facing the trailing edge, of the projection 20 is designed such that it runs at a smooth angle to the pressure-side contour line of the shroud, that is to say, on the one hand, it does not fall away abruptly with respect to the rotation direction C, while on the other hand it falls away to a sufficient extent that the mass of the projection is limited.

FIG. 2*b* also shows the shielding effect which is achieved by the projection 20. The projection, and in particular its axial extent, ensure that at least the largest water droplets are deflected and do not strike the shroud fillet of the next blade shroud in the flow direction in the blade row. The lines $W_0$ indicate flow paths of relatively small water droplets, while the lines $W_1$ represent a flow path of larger water droplets. The former relatively small droplets are not deflected from their flow path by the projection and, as before, strike the shroud fillet of the next blade. However, because of their small mass, they cause only limited erosion damage in that area. In contrast, the majority of the larger water droplets are deflected by the projection 20. Larger water droplets strike only the leading edge 16 of the next blade. Because this edge is hardened, there is, however, no damage there.

Figure 3:
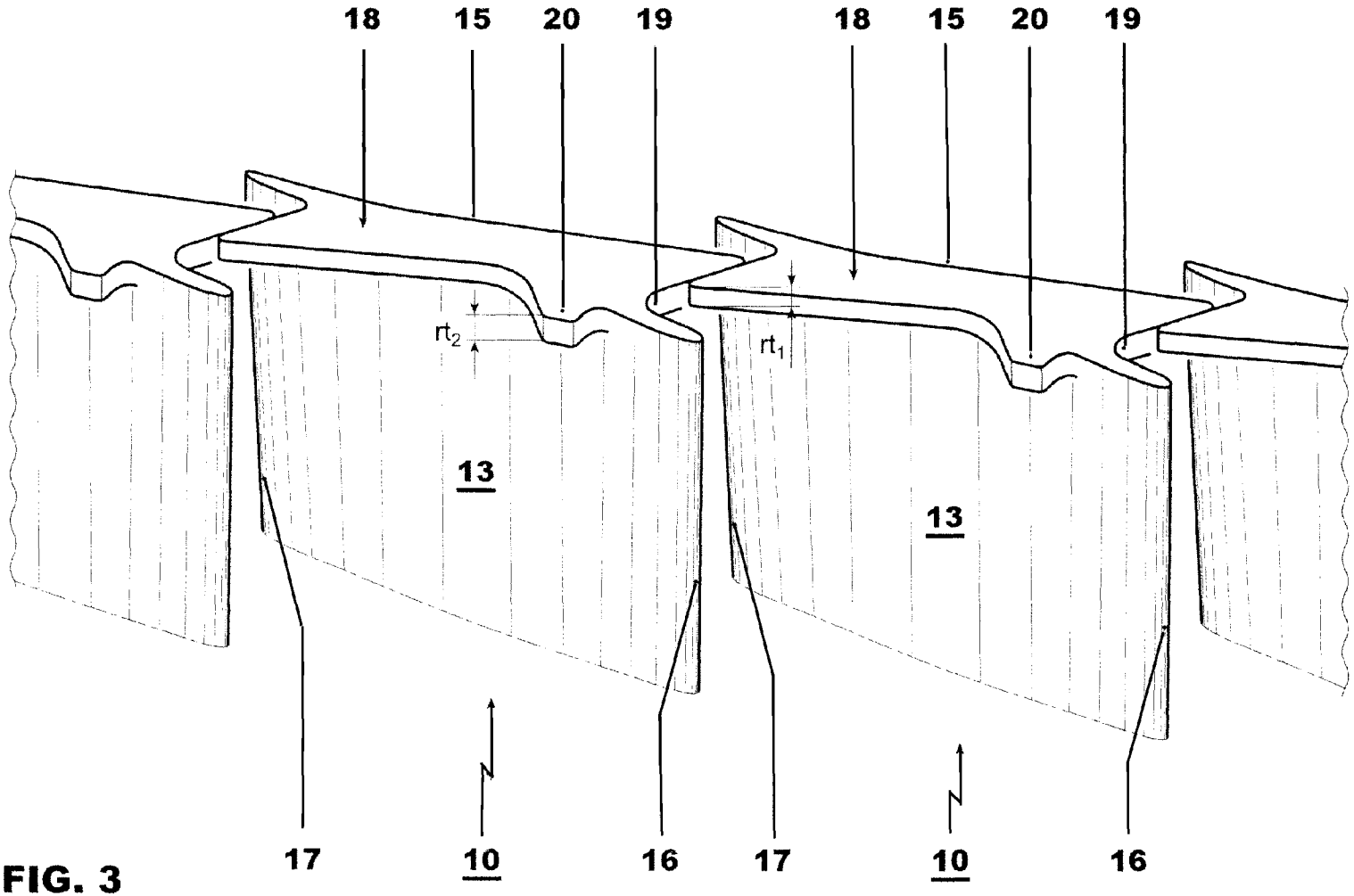
FIG. 3 shows a perspective view of shrouds according to the invention on a row of final stage blades of a steam turbine.

FIG. 3 shows blades 10 in a blade row for the final stage of a steam turbine, in each case with a shroud 18 according to the invention as shown in FIG. 2*b*. The figure additionally shows the radial extents of the shroud 18. In particular, the overhang of the shroud in the area of the trailing edge 17 of the blade has a radial thickness $rt_1$ while, in the area of the projection 20, the radial thickness of the shroud, annotated $rt_2$, is greater than $rt_1$ in the trailing-edge area. This is necessary in order to ensure adequate shielding of the shroud fillet of the next blade in the flow direction against large water droplets. For strength reasons, the projection 20 is not arranged in the area of the trailing edge, because the overhang, which already exists there, would otherwise project too far over the pressure side of the airfoil 13, and would represent an excessively high risk to the strength of the shroud. Since, instead of this, the projection is arranged in the area of the leading edge, its radial extent and its axial extent are correspondingly designed to be sufficiently great that the desired shielding is nevertheless achieved.

List of Reference Symbols

1 Final stage blade in the blade run

2 Blade foot

3 Airfoil
4 Pressure side
5 Suction side
6 Leading edge
6' Suction-side part of the shroud
6" Pressure-side part of the shroud
7 Trailing edge
8 Shroud
9 Suction-side shroud fillet
10 Blade
13 Airfoil
14 Pressure side
15 Suction side
16 Leading edge
16' suction-side part of the shroud
16" Pressure-side part of the shroud
17 Trailing edge
18 Shroud
19 Suction-side shroud fillet
20 Projection
21 Recess
22 Trailing flank
$\alpha$ Angle between the circumferential direction and the line from the leading edge to the projection maximum
A Axial direction parallel to the turbine rotor axis
B Line through the maximum extent of the leading edge and the maximum extent of the projection
C Circumferential direction, rotation direction
$E_{max}$ Maximum axial extent of the projection
W Path of water droplets
$W_0$ Flow path of relatively large water droplets
$W_1$ Flow path of relatively small water droplets
$rt_1$ Radial extent of the shroud in the overhang at the trailing edge
$rt_2$ Radial extent of the shroud in the projection

What is claimed is:

1. A rotating blade row for a final stage of a steam turbine having blades in each case with an integrated shroud, the shroud of each blade in the row has a projection located towards a leading edge end of each blade on a pressure side thereof, for shielding a suction-side shroud fillet of a next blade in a flow direction against at least a portion of water droplets.

2. The rotating blade row as claimed in claim 1, wherein the projection extends from the pressure side of the shroud in an axial direction parallel to a rotor axis of the steam turbine.

3. The rotating blade row as claimed in claim 1, wherein the projection is arranged sufficiently remotely from the shroud on a trailing edge of the blades such that mass equilibrium of the shroud is ensured between the suction side and pressure side of the shroud.

4. The rotating blade row as claimed in claim 3, wherein the projection is arranged in a portion of the shroud which faces a leading edge.

5. The rotating blade row as claimed in claim 2, wherein a recess is provided between the leading edge of the blades and a maximum extent of the projection in the axial direction, parallel to the rotor axis of the steam turbine.

6. The rotating blade row as claimed in claim 1, wherein a radial extent of the projection is greater than a radial extent of the shroud in an area of a trailing edge of the blades.

* * * * *